US010450516B2

(12) United States Patent
Rankin et al.

(10) Patent No.: US 10,450,516 B2
(45) Date of Patent: Oct. 22, 2019

(54) CATALYTIC CAUSTIC DESULFONYLATION

(71) Applicants: AUTERRA, INC., Schenectady, NY (US); CENOVUS ENERGY INC., Calgary, Alberta (CA)

(72) Inventors: Jonathan Rankin, Galway, NY (US); Sarah Briggs, Colonie, NY (US)

(73) Assignees: AUTERRA, INC., Schenectady, NY (US); CENOVUS ENERGY INC., Calgary (CA)

( * ) Notice: Subject to any disclaimer, the term of this patent is extended or adjusted under 35 U.S.C. 154(b) by 245 days.

(21) Appl. No.: 15/451,981

(22) Filed: Mar. 7, 2017

(65) Prior Publication Data

US 2017/0260462 A1 Sep. 14, 2017

Related U.S. Application Data

(60) Provisional application No. 62/305,039, filed on Mar. 8, 2016.

(51) Int. Cl.
*C10G 45/04* (2006.01)

(52) U.S. Cl.
CPC ..... *C10G 45/04* (2013.01); *C10G 2300/202* (2013.01)

(58) Field of Classification Search
CPC ..... C10G 27/00; C10G 27/10; C10G 45/02; C10G 45/04; C10G 45/22; C10G 2300/202
See application file for complete search history.

(56) References Cited

U.S. PATENT DOCUMENTS 1,796,621 A 3/1931 Ramage
2,110,283 A 3/1938 Archibald
(Continued)

FOREIGN PATENT DOCUMENTS

FR 82735 A 4/1938
MX 171286 A 10/1993
(Continued)

OTHER PUBLICATIONS

Jain, Suman L., et al. Rehenium-Catalyzed Highly Efficient Oxidations of Tertiary Nitrogen Compounds to N-Oxides Using Sodium Percarbonate as Oxygen Source. Synlett, 2006, No. 16, pp. 2661-2663. Published on Web Sep. 22, 2006 (Doc 1).
(Continued)

*Primary Examiner* — Randy Boyer
*Assistant Examiner* — Brandi M Doyle
(74) *Attorney, Agent, or Firm* — Schmeiser, Olsen & Watts, LLP

(57) ABSTRACT

A caustic desulfonylation method and system comprising a reactor vessel with a solid carbonaceous selectivity promoter provided therein, a liquid feed input of the reactor vessel configured to receive a source of caustic, a hydrocarbon feed comprising oxidized sulfur containing compounds and a gas feed input of the reactor vessel configured to receive a source of hydrogen. The caustic desulfonylation method and system further includes an output of the reactor vessel releasing the caustic and an upgraded hydrocarbon product with sulfur content less than the sulfur content of the hydrocarbon feed received by the liquid feed of the reactor vessel.

16 Claims, 2 Drawing Sheets

(56) References Cited

U.S. PATENT DOCUMENTS 2,764,525 A 9/1956 Porter et al.
2,771,402 A 11/1956 Birch et al.
2,789,134 A 4/1957 Nelson et al.
2,910,434 A 10/1959 Hess et al.
2,987,470 A 6/1961 Turken
3,136,714 A 6/1964 Gibson et al.
3,164,545 A 1/1965 Mattox
3,505,210 A 4/1970 Wallace et al.
3,558,747 A 1/1971 Meltsner
3,565,793 A 2/1971 Herbstman et al.
3,668,117 A 6/1972 Patel et al.
3,819,509 A 6/1974 Wolk et al.
3,847,797 A 11/1974 Pasternak et al.
3,945,914 A 3/1976 Yoo et al.
3,948,759 A 4/1976 King et al.
3,957,620 A 5/1976 Fukui et al.
3,960,706 A 6/1976 McCollum
3,960,708 A 6/1976 McCollum
3,964,995 A 6/1976 Wolk et al.
4,003,823 A 1/1977 Baird et al.
4,119,528 A 10/1978 Baird, Jr. et al.
4,127,470 A 11/1978 Baird, Jr. et al.
4,192,736 A 3/1980 Kluksdahl
4,224,140 A 9/1980 Fujimori et al.
4,374,949 A 2/1983 Massey et al.
4,437,980 A 3/1984 Heredy et al.
4,444,655 A 4/1984 Shiroto et al.
4,591,426 A 5/1986 Krasuk et al.
4,645,589 A 2/1987 Krambeck et al.
4,665,261 A 5/1987 Mazurek
4,923,682 A 5/1990 Roberts
5,064,523 A 11/1991 Kretschmar et al.
5,089,149 A 2/1992 Ridland et al.
5,166,118 A 11/1992 Kretschmar et al.
5,288,681 A 2/1994 Gatsis
5,616,751 A 4/1997 Takeshi et al.
5,637,739 A 6/1997 Jacobsen et al.
6,087,662 A 7/2000 Litz et al.
6,160,193 A 12/2000 Gore
6,245,223 B1 6/2001 Gorbaty et al.
6,342,191 B1 1/2002 Kepner et al.
6,368,495 B1 4/2002 Kocal et al.
6,403,526 B1 6/2002 Lussier et al.
6,406,616 B1 6/2002 Rappas et al.
6,471,852 B1 10/2002 Mark et al.
6,544,409 B2 4/2003 DeSouza
6,547,957 B1 4/2003 Sudhakar et al.
6,579,472 B2 6/2003 Chung et al.
6,673,236 B2 1/2004 Stanciulescu et al.
6,846,406 B2 1/2005 Canos et al.
7,144,499 B2 12/2006 Han et al.
7,153,414 B2 12/2006 DeSouza
7,179,368 B2 2/2007 Rabion et al.
7,314,545 B2 1/2008 Karas et al.
7,371,318 B2 5/2008 Corma Canos et al.
7,374,666 B2 5/2008 Wachs
7,598,426 B2 10/2009 Fang et al.
7,648,625 B2 1/2010 Bhan et al.
7,678,264 B2 3/2010 Bhan
7,749,374 B2 7/2010 Bhan et al.
7,790,021 B2 9/2010 Kocal et al.
7,794,843 B2 9/2010 Yamane et al.
7,875,185 B2 * 1/2011 Zhang ..... B01D 15/00 208/235
7,919,992 B2 4/2011 Bhan
8,088,706 B2 1/2012 Domokos et al.
8,187,991 B2 5/2012 Osaheni et al.
8,197,671 B2 6/2012 Rankin et al.
8,241,490 B2 8/2012 Litz et al.
8,283,498 B2 10/2012 Litz et al.
8,298,404 B2 10/2012 Litz et al.
8,372,777 B2 2/2013 Bhan et al.
8,394,261 B2 3/2013 Litz et al.
8,409,541 B2 4/2013 Reynolds et al.
8,444,061 B2 5/2013 Van Den Berg et al.
8,450,538 B2 5/2013 Bhan et al.
8,481,450 B2 7/2013 Bhan
8,492,599 B2 7/2013 Bhan et al.
8,530,370 B2 9/2013 Donaho
8,562,817 B2 10/2013 Milam et al.
8,562,818 B2 10/2013 Milam et al.
8,597,608 B2 12/2013 Reynolds et al.
8,608,946 B2 12/2013 Bhan et al.
8,764,973 B2 7/2014 Litz et al.
8,877,013 B2 11/2014 Litz et al.
8,877,043 B2 11/2014 Litz et al.
8,894,843 B2 11/2014 Rankin et al.
8,961,779 B2 2/2015 Litz et al.
9,061,273 B2 6/2015 Litz et al.
9,206,359 B2 12/2015 Litz et al.
9,512,151 B2 12/2016 Litz
9,828,557 B2 11/2017 Rankin
2002/0177522 A1 11/2002 Alexander, IV et al.
2002/0189975 A1 12/2002 DeSouza
2003/0000867 A1 1/2003 Reynolds
2003/0024432 A1 2/2003 Chung et al.
2003/0149317 A1 8/2003 Rendina
2004/0108252 A1 6/2004 DeSouza
2004/0178121 A1 9/2004 Leyshon et al.
2004/0178122 A1 9/2004 Karas et al.
2004/0222134 A1 11/2004 DeSouza
2004/0238410 A1 12/2004 Inoue et al.
2005/0014850 A1 1/2005 Hu
2005/0023188 A1 2/2005 Connor
2005/0231457 A1 10/2005 Yamamoto et al.
2006/0011510 A1 1/2006 Toshima et al.
2006/0144793 A1 7/2006 Dadachov
2006/0154814 A1 7/2006 Zanibelli et al.
2006/0180501 A1 8/2006 Da Silva et al.
2006/0231456 A1 10/2006 Bhan
2006/0234876 A1 10/2006 Bhan
2007/0000810 A1 1/2007 Bhan et al.
2007/0051667 A1 3/2007 Martinie et al.
2007/0256980 A1 11/2007 Krogue
2007/0295646 A1 12/2007 Bhan et al.
2008/0083650 A1 4/2008 Bhan et al.
2008/0087575 A1 4/2008 Bhan et al.
2008/0121565 A1 5/2008 Yoo et al.
2008/0135449 A1 6/2008 Bhan et al.
2008/0308463 A1 12/2008 Keckler et al.
2009/0065399 A1 3/2009 Kocal et al.
2009/0188836 A1 7/2009 Bhan et al.
2010/0055005 A1 3/2010 Bhan et al.
2010/0098602 A1 4/2010 Bhan et al.
2011/0000823 A1 1/2011 Hamad et al.
2011/0011771 A1 1/2011 Litz et al.
2011/0031164 A1 * 2/2011 Litz ..... C10G 19/073 208/266
2011/0108464 A1 5/2011 Rankin et al.
2011/0119988 A1 5/2011 Litz et al.
2011/0147274 A1 6/2011 Soto
2011/0178346 A1 7/2011 Milam et al.
2011/0178376 A1 7/2011 Milam et al.
2011/0192762 A1 8/2011 Wellington et al.
2011/0210043 A1 9/2011 Wellington et al.
2011/0294657 A1 12/2011 Soled et al.
2012/0055843 A1 3/2012 Bourane et al.
2012/0055844 A1 3/2012 Bourane et al.
2012/0055845 A1 3/2012 Bourane et al.
2012/0055849 A1 3/2012 Bourane et al.
2012/0067777 A1 3/2012 Litz et al.
2012/0074040 A1 3/2012 Koseoglu et al.
2012/0152804 A1 6/2012 Koseoglu et al.
2012/0285864 A1 * 11/2012 Rankin ..... C10G 7/00 208/220
2012/0285866 A1 * 11/2012 Litz ..... C10G 19/073 208/282
2013/0015104 A1 1/2013 Al-Haji et al.
2013/0026062 A1 1/2013 Al-Shahrani et al.
2013/0026071 A1 1/2013 Koseoglu et al.
2013/0026075 A1 1/2013 Koseoglu et al.
2013/0028822 A1 1/2013 Bourane et al.
2013/0030236 A1 * 1/2013 Koseoglu ..... B01J 37/06 585/852

(56) References Cited

U.S. PATENT DOCUMENTS

| | | | |
|---|---|---|---|
| 2013/0048543 | A1 | 2/2013 | Litz et al. |
| 2013/0075305 | A1 | 3/2013 | Al-Shafei et al. |
| 2013/0130892 | A1 | 5/2013 | Litz |
| 2013/0171039 | A1 | 7/2013 | Graham et al. |
| 2013/0185044 | A1 | 7/2013 | Chen et al. |
| 2013/0315793 | A1 | 11/2013 | Koseoglu et al. |
| 2013/0334103 | A1 | 12/2013 | Bourane et al. |
| 2014/0024569 | A1 | 1/2014 | Bera et al. |
| 2014/0131256 | A1 | 5/2014 | Litz et al. |
| 2014/0151305 | A1 | 6/2014 | Schrage et al. |
| 2014/0216984 | A1 | 8/2014 | Litz et al. |
| 2014/0291199 | A1 | 10/2014 | Litz et al. |
| 2014/0339136 | A1 | 11/2014 | Litz et al. |
| 2015/0184086 | A1 | 7/2015 | Rankin et al. |
| 2015/0337208 | A1 | 11/2015 | Litz et al. |
| 2015/0337220 | A1 | 11/2015 | Litz et al. |
| 2016/0281003 | A1 | 9/2016 | Litz et al. |

FOREIGN PATENT DOCUMENTS

| | | | |
|---|---|---|---|
| RU | 2087520 | C1 | 8/1997 |
| WO | 2006093799 | A2 | 9/2006 |
| WO | 2008153633 | A1 | 12/2008 |
| WO | 2009120238 | A1 | 10/2009 |
| WO | 2012039910 | A1 | 3/2012 |
| WO | 2012051009 | A1 | 4/2012 |
| WO | 2013188144 | A1 | 12/2013 |
| WO | 2014018082 | A1 | 1/2014 |
| WO | 2016154529 | A1 | 9/2016 |

OTHER PUBLICATIONS

McKillop, Alexander, et al. Further Functional-Group Oxidations Using Sodium Perborate. Tetrahedron, vol. 45, No. 11, pp. 3299 to 3306, 1989. Published in Great Britain (Doc. 2).

Varma, Rajender S., et al. The Urea-Hydrogen Peroxide Complex: Solid-State Oxidative Protocols for Hydroxylated Aldehydes and Ketones (Dakin Reaction), Nitriles, Sulfides, and Nitrogen Heterocycles. Organic Letters, 1999, vol. 1, No. 2, pp. 189-191. Published on Web May 29, 1999 (Doc. 3).

Jana, Nirmal K., et al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003 (Doc. 4).

Khodaei, Mohammad Mehdi, et al. H2O2/Tf2O System: An Efficient Oxidizing Reagent for Selective Oxidation of Sulfanes. Synthesis, 2008; No. 11, pp. 1682-1684. Published on Web Apr. 11, 2008 (Doc. 5).

Kim, Sung Soo, et al. A Mild and Highly Efficient Oxidation of Sulfide to Sulfoxides with Periodic Acid Catalyzed by FeCl3. Synthesis, 2002, No. 17, pp. 2484-2486. Published USA Feb. 12, 2002 (Doc. 6).

Qian, Weixing, et al. Efficient and Highly Selective Oxidation of Sulfides to Sulfoxides in the Presence of an Ionic Liquid Containing Hypervalent Iodine. Synlett, 2006, No. 5, pp. 709-712. Published on Web Mar. 9, 2006 (Doc. 7).

Matteucci, Mizio, et al. Mild and Highly Chemoselective Oxidation of Thioethers Mediated by Sc(OTf)3. Organic Letters, 2003, vol. 5, No. 3, 235-237. Published on Web Jan. 11, 2003 (Doc. 8).

Mba, Myriam, et al. C3-Symmetric Ti(IV) Triphenolate Amino Complexes as Sulfoxidation Catalysts with Aqueous Hydrogen Peroxide. Organic Letters, 2007, vol. 9, No. 1, pp. 21-24. Published on Web Dec. 9, 2006 (Doc. 9).

Drago, Carmelo, et al. Vanadium-Catalyzed Sulfur Oxidation/Kinetic Resolution in the Synthesis of Enantiomerically Pure Alkyl Aryl Sulfoxides. Agnew. Chem. Int. Ed, 2005, 44, pp. 7221-7223. Published on Web Oct. 17, 2005 (Doc. 10).

Egami, Hiromichi, et al. Fe(salan)-Catalyzed Asymmetric Oxidation of Sulfides with Hydrogen Peroxide in Water. J. Am. Chem. Soc., 2007, vol. 129, No. 29, pp. 8940-8941. Published on Web Jun. 29, 2007 (Doc. 11).

Sun, Jiangtao, et al. Efficient Asymmetric Oxidation of Sulfides and Kinetic Resolution of Sulfoxides Catalyzed by a Vanadium-Salan System. J. Org. Chem., 2004, vol. 69, No. 24, pp. 8500-8503. Published on Web Oct. 28, 2004 (Doc. 12).

Karimi, Babak, et al. Selective Oxidation of Sulfides to Sulfoxides Using 30% Hydrogen Peroxide Catalyzed with a Recoverable Silica-Based Tungstate Interphase Catalyst. Organic Letters, 2005, vol. 7, No. 4, pp. 625-628. Published on Web Jan. 25, 2005 (Doc. 13).

Ali, Mohammed Hashmat, et al. Ceric Ammonium Nitrate Catalyzed Oxidation of Sulfides to Sulfoxides. Synthesis, 2007, No. 22, pp. 3507-3511. Published on Web Oct. 16, 2007 (Doc. 14).

Imada, Yasushi, et al. Flavin Catalyzed Oxidations of Sulfides and Amines with Molecular Oxygen. J. Am Chem. Soc., 2003, vol. 125, No. 10, pp. 2868-2869. Published on Web Feb. 12, 2003 (Doc 15).

Varma, Rajender S., et al. The Urea-Hydrogen Peroxide Complex: Solid-State Oxidatives Protocols for Hydroxylated Aldehydes and Ketones (Dakin Reaction), Nitriles, Sulfides, and Nitrogen Heterocycles. Organic Letters, 1999, vol. 1, No. 2, pp. 189-191 Published on Web May 29, 1999 (Doc. 16).

Jana, Nirmal K.,e t al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003 (Doc. 17).

Shaabani, Ahmad, et al. Green oxidations. The use of potassium permanganate supported on manganese dioxide. Tetrahedron, 2004, 60, pp. 11415-11420. Published on Web Oct. 12, 2004 (Doc. 18).

Wozniak, Lucyna A., et al. Oxidation in Organophosphorus Chemistry: Potassium Peroxymonosulphate. Tetrahedron, 1999, 40, pp. 2637-2640. Received Oct. 13, 1998; Accepted Feb. 3, 1999. No published date. (Doc. 19).

Akasaka, Takeshi,e t al. Singlet Oxygen Oxidation of Organophosphorus Compounds: Cooxidation of Olefin with Phosphadioxirane. Quimica Nova, 1993, 16, pp. 325-327. No published date or location (Doc. 20).

Milner, O.I., et al. Determination of Trace Materials in Crudes and Other Petroleum Oils. Analytical Chemistry, vol. 24, No. 11. Published Nov. 1952, USA (Doc. 21).

Aida, Tetsuo, et al. Development of an Efficient Coal-Desulfurization process: "Oxy-Alkalinolysis". Technical Report Resource Conference: American Chemical Society symposium on coal liquefaction, pp. 328-334. Kansas City, MO USA. Published Sep. 1, 1982 Ames Lab., IA (USA); Advanced Fuel Research, Inc., East Hartford, CT (USA) (Doc. 22).

Aida, Tetsuo, et al. Reaction of Dibenzothiophene Sulfone with Alkoxides. Tetrahedron Letters (1983), vol. 24, No. 34, pp. 3543-3546. USA (Doc. 23).

Oviedo, Alberto, et al. Deoxydesulfurization of sulfones derived from dibenzothiophene using nickel compounds. Journal of Molecular Catalysis A: Chemical, (2008) 293, pp. 65-71. USA (Doc. 24).

Ripin, D.H., et al., "pKa's of Inorganic and Oxo-Acids", [http://evans.harvard.edu/pdf/evans_pka_table.pdf]; published Apr. 11, 2005, accessed Apr. 29, 2013. 6 pages.

Application No. PCT/US2008/82095, International Search Report and the Written Opinion of the International Searching Authority, or the Declaration dated Mar. 20, 2009. 12 pages.

Application No. PCT/US2011/50159, International Search Report and the Written Opinion of the International Searching Authority dated Jan. 12, 2012, 11 pages.

Application No. PCT/US2011/54840, International Search Report and the Written Opinion of the International Searching Authority dated Mar. 12, 2012, 8 pages.

Application No. PCT/US2011/70243, Internatinoal Search Report and the Written Opinion of the International Searching Authority dated Feb. 25, 2013, 40 pages.

Application No. PCT/US2013/43843, International Search Report and the Written Opinion of the International Searching Authority dated Aug. 27, 2013, 7 pages.

Energy Intelligence Group. (2007). "The Crude Oils and their Key Characteristics, " 7 pgs. (Available at http://www.energyintel.com/pages/eig_article.aspx?DocId=200017).

El Nady, M. M. et al. (2013). Journal of Chemical and Engineering Data, 1, 1-7.

(56) References Cited

OTHER PUBLICATIONS

Canadian Office Action for Appln. No. 2,719,058, dated Dec. 31, 2014.
Korean Office Action Translation for KR Appln. No. 2009-7024832.
Indian Office Action for IN Application No. 1992/MUMNP/2010, dated Mar. 26, 2015.
European Office Action for Application No. 11 833 137.0-1361, dated Aug. 13, 2015.
Office Action (dated Jun. 15, 2016) for U.S. Appl. No. 14/246,508, filed Apr. 7, 2014.
International Search Report and Written Opinion (dated Aug. 5, 2015) for PCT Application No. PCT/US15/32417.
International Search Report and Written Opinion (dated Jun. 20, 2016) for PCT Application No. PCT/US16/024201.
Office Action for Canadian Application No. 2,719,058, dated Aug. 9, 2016.
http:/ /evans.rc.fas.harvard.edu/pdf/evans _pKa table. Pdf.
Jiang, Benpeng et al., ("Hydrothermal synthesis of rutile TiO2 nanoparticles using hydroxyl and carboxyl group-containing organics as modifiers." Materials Chemistry and Physics, pp. 231-235), 2006.
EP Office Action for EP Application No. 13 803 981.3, dated Dec. 6, 2016.
GCC Patent Office Exam Report for Application No. GC 2013-24619, dated Nov. 26, 2016.
Office Action (dated Feb. 22, 2017) for U.S. Appl. No. 14/629,169, filed Feb. 23, 2015.
Pyatnaskii, I.V., et al., "Photometric investigation of Fe(II) and Ti(IV) complexes and mannitol and glycerol in solutios," CA, Chemical Abstracts Service, Columbus, Ohio, US, (1963), (Russian Edition), Database accession No. 59:33671, URL: STN, XP002649502; Ukrainskii Khimicheskii Zhurnal, (1963), pp. 440-449 (English Translation of Abstract Only), 11 pages.
Chinese Patent Application No. 201380015161.1, Office Action dated Nov. 16, 2015.
European Patent Application No. 13 803 981.3, Extended European Search Report dated Mar. 11, 2016, 10 pages.
Indian Patent Application No. 9011/CHENP/2014, Office Action dated Aug. 27, 2018.
Iraqi Patent Application No. 2013/188, Office Action forwarded on Jul. 21, 2013.
Mexican Patent Application No. MX/a/2014/014432 , Office Action received on Jul. 31, 2017.
Russian Patent Application No. 2014152661/04, Search Report dated Apr. 25, 2017.
Australian Patent Application No. 2008353354, Office Action dated Mar. 23, 2013, 4 pages.
Canadian Patent Application No. 2,719,058, Office Action dated Jun. 19, 2015, 4 pages.
Canadian Patent Application No. 2,719,058, Office Action dated Jan. 11, 2016, 3 pages.
Canadian Patent Application No. 2,719,058, Notice of Allowance dated Feb. 21, 2017.
Chilean Patent Application No. 1040-2010, Office Action forwarded on Mar. 3, 2014.
Chilean Patent Application No. 1040-2010, Office Action forwarded on Oct. 3, 2014.
Chinese Patent Application No. 200880128410.7, Office Action forwarded on Jan. 29, 2013.
Chinese Patent Application No. 200880128410.7, Office Action forwarded on May 23, 2013.
Chinese Patent Application No. 200880128410.7, Office Action forwarded on Dec. 3, 2013.
Egyptian Patent Application No. 2010/09/1614, Office Action dated Sep. 26, 2012.
Egyptian Patent Application No. 2010/09/1614, Office Action dated Feb. 3, 2013.
Egyptian Patent Application No. 2010/1614 D2, Office Action forwarded on Feb. 2, 2014.
Egyptian Patent Application No. 2010/1614 D1, Office Action forwarded on Dec. 30, 2013.
European Patent Application No. 08873622.8, Extended European Search Report dated Apr. 24, 2013, 8 pages.
GCC Patent Application No. GCC/P.2009/13131, Examination Report dated Apr. 17, 2014, 6 pages.
GCC Patent Application No. GCC/P.2009/13131, Examination Report dated Feb. 3, 2016, 9 pages.
GCC Patent Application No. GCC/P/2009/27433, Examination Report dated May 13, 2018, 5 pages.
Indonesian Patent Application No. W00201003533, Office Action dated Jun. 16, 2014, 2 pages.
Iraqi Patent Application No. 285/2010, Office Action forwarded on Feb. 24, 2013.
Iraqi Patent Application No. 285/2010, Office Action forwarded on May 26, 2013.
Iraqi Patent Application No. 285/2010, Office Action forwarded on Feb. 11, 2014.
Japanese Patent Application No. 2011-501781, Office Action dated Sep. 12, 2013, 4 pages.
Examiner's Action in Canadian Patent Application No. 2,810,690 dated Apr. 8, 2018.
Office Action in Canadian Patent Application No. 2,810,690 dated Jul. 24, 2017.
Office Action in Indian Patent Application No. 1766/CHENP/2013 dated Jan. 25, 2018.
Office Action in Brazilian Patent Application No. BR 11 2013 006559-1 dated Jan. 28, 2019. 5 pages.
Brazilian Patent Application No. 0809881-6, Office Action dated Jan. 15, 2019, 4 pages.
GCC Patent Application No. GC 2011-19492, Examination Report dated Dec. 29, 2015, 4 pages.
GCC Patent Application No. GC 2011-19492, Examination Report dated Aug. 24, 2017, 4 pages.
Office Action in Canadian Patent Application No. 2,808,640 dated Oct. 17, 2017, 3 pages.
Office Action in Indian Patent Application No. 1765/CHENP/2013 dated Feb. 9, 2018.
Mexican Patent Application No. MX/a/2015/000923 , Office Action received on Sep. 12, 2017. 4 pages.
Indian Patent Application No. 8430/CHENP/2014, Office Action dated Aug. 17, 2018, 6 pages.
Canadian Patent Application No. 2,879,626, Examination Search Report dated Dec. 31, 2018.
International Search Report and Written Opinion (dated Aug. 4, 2015) for PCT Application No. PCT/US15/31461.
International Search Report and Written Opinion (dated Feb. 16, 2016) for PCT Application No. PCT/US15/064587.
Notice of Allowance for Canadian Appln No. 2,705,456, dated Sep. 17, 2015.
Notice of Allowance (dated Feb. 13, 2012) for U.S. Appl. No. 12/977,639, filed Dec. 23, 2010.
Office Action (dated Aug. 19, 2013) for U.S. Appl. No. 13/493,240, filed Jun. 11, 2012.
Office Action (dated Jan. 3, 2014) for U.S. Appl. No. 13/493,240, filed Jun. 11, 2012.
Office Action (dated Mar. 20, 2014) for U.S. Appl. No. 13/493,240, filed Jun. 11, 2012.
Notice of Allowance (dated Jul. 17, 2014) for U.S. Appl. No. 13/493,240, filed Jun. 11, 2012.
Office Action (dated Apr. 11, 2012) for U.S. Appl. No. 12/933,898, filed Sep. 22, 2010.
Notice of Allowance (dated Apr. 4, 2019) for U.S. Appl. No. 16/285,532, filed Mar. 26, 2019.
Office Action (dated Oct. 18, 2012) for U.S. Appl. No. 12/933,898, filed Sep. 22, 2010.
Notice of Allowance (dated Nov. 9, 2012) for U.S. Appl. No. 12/933,898, filed Sep. 22, 2010.
Office Action (dated Nov. 10, 2014) for U.S. Appl. No. 13/734,054, filed Jan. 4, 2013.
Notice of Allowance (dated Feb. 27, 2015) for U.S. Appl. No. 13/734,054, filed Jan. 4, 2013.

(56) References Cited

OTHER PUBLICATIONS

Notice of Allowance (dated Jul. 9, 2012) for U.S. Appl. No. 12/888,049, filed Sep. 22, 2010.
Office Action (dated Jun. 6, 2013) for U.S. Appl. No. 13/660,371, filed Oct. 25, 2012.
Office Action (dated Nov. 12, 2013) for U.S. Appl. No. 13/660,371, filed Oct. 25, 2012.
Notice of Allowance (dated Jun. 24, 2014) for U.S. Appl. No. 13/660,371, filed Oct. 25, 2012.
Office Action (dated Jun. 25, 2014) for U.S. Appl. No. 14/246,597, filed Apr. 7, 2014.
Notice of Allowance (dated Aug. 14, 2014) for U.S. Appl. No. 14/246,597, filed Apr. 7, 2014.
Office Action (dated Jun. 19, 2014) for U.S. Appl. No. 14/159,833, filed Jan. 21, 2014.
Notice of Allowance (dated Oct. 27, 2014) for U.S. Appl. No. 14/159,833, filed Jan. 21, 2014.
Notice of Allowance (dated Jul. 21, 2017) or U.S. Appl. No. 14/629,169, filed Feb. 23, 2015.
Office Action (dated Mar. 20, 2012) for U.S. Appl. No. 12/598,474, filed Apr. 23, 2010.
Office Action (dated Oct. 15, 2012) for U.S. Appl. No. 12/598,474, filed Apr. 23, 2010.
Office Action (dated Sep. 11, 2014) for U.S. Appl. No. 12/598,474, filed Apr. 23, 2010.
Advisory Action (dated Dec. 10, 2014) for U.S. Appl. No. 12/598,474, filed Apr. 23, 2010.
Office Action (dated May 11, 2015) for U.S. Appl. No. 12/598,474, filed Apr. 23, 2010.
Office Action (dated Nov. 20, 2015) for U.S. Appl. No. 12/598,474, filed Apr. 23, 2010.
Final Office Action (dated May 6, 2016) for U.S. Appl. No. 12/598,474, filed Apr. 23, 2010.
Notice of Allowance (dated Aug. 9, 2016) for U.S. Appl. No. 12/698,474, filed Apr. 23, 2010.
Notice of Allowance (dated Feb. 13, 2012) for U.S. Appl. No. 12/904,446, filed Oct. 14, 2010.
Office Action (dated Aug. 15, 2013) for U.S. Appl. No. 13/560,584, filed Jul. 27, 2012.
Office Action (dated Dec. 17, 2013) for U.S. Appl. No. 13/560,584, filed Jul. 27, 2012.
Office Action (dated Feb. 27, 2014) for U.S. Appl. No. 13/560,584, filed Jul. 12, 2012.
Notice of Allowance (dated Apr. 29, 2014) for U.S. Appl. No. 13/560,584, filed Jul. 12, 2012.
Office Action (dated Feb. 24, 2017) for U.S. Appl. No. 14/246,508, filed Apr. 7, 2014.
Office Action (dated Jan. 21, 2015) for U.S. Appl. No. 14/287,916, filed May 27, 2014.
Office Action (dated Jun. 19, 2015) for U.S. Appl. No. 14/287,916, filed May 27, 2014.
Notice of Allowance (dated Aug. 4, 2015) for U.S. Appl. No. 14/287,916, filed May 27, 2014.
Office Action (dated Apr. 22, 2016) for U.S. Appl. No. 14/286,342, filed May 23, 2014.
Office Action (dated Apr. 20, 2016) for U.S. Appl. No. 14/573,230, filed Dec. 17, 2014.
Restriction Requirement (dated Sep. 5, 2017) for U.S. Appl. No. 15/080,784, filed Mar. 25, 2016.
Ex Parte Quayle (dated Sep. 7, 2018) for U.S. Appl. No. 15/080,784, filed Mar. 25, 2016.
Notice of Allowance (dated Nov. 20, 23018) for U.S. Appl No. 15/080,784, filed Mar. 25, 2016.

* cited by examiner

CATALYTIC CAUSTIC DESULFONYLATION

CROSS REFERENCE TO RELATED APPLICATIONS

This application claims the priority and benefit of U.S. Patent Application No. 62/305,039 filed on Mar. 8, 2016, entitled "CATALYTIC CAUSTIC DESULFONYLATION", the contents of which are hereby incorporation by reference.

FIELD OF THE TECHNOLOGY

The following relates generally to methods and systems for performing caustic desulfonylation, and more specifically to in-situ regenerable caustic desulfonylation methods and systems.

BACKGROUND

Heavy oils and bitumens make up an increasing percentage of hydrocarbon resources. As the demand for hydrocarbon-based fuels has increased, a corresponding need has developed for improved processes for desulfurizing oil feed streams. Processes for the conversion of the heavy portions of these feed streams into more valuable, lighter fuel products have also taken on greater importance. These heavy oil feed streams include, but are not limited to, whole and reduced petroleum crudes, shale oils, coal liquids, atmospheric and vacuum residua, asphaltene, de-asphalted oils, cycle oils, FCC tower bottoms, gas oils, including atmospheric and vacuum gas oils and coker gas oils, light to heavy distillates including raw virgin distillates, hydrocrackers, hydrotreated oils, dewaxed oils, slack waxes, raffinates, and mixtures thereof.

Hydrocarbon streams having a boiling point above 220° C. often contain a considerable amount of large multi-ring hydrocarbon molecules and/or a conglomerated association of large molecules. These larger molecules and conglomerations often contain a large portion of the sulfur, nitrogen and metals in the hydrocarbon stream, which may be referred to as heteroatom contaminants in U.S. Pat. No. 8,764,973 to Litz et al., the contents of which are hereby incorporated by reference in its entirety, except where inconsistent with the content of the current disclosure. A significant portion of the sulfur contained in these heavy oils is in the form of heteroatoms in polycyclic aromatic molecules, comprised of sulfur compounds such as dibenzothiophenes, from which the sulfur is difficult to remove.

The processing of bitumens, crude oils, or other heavy oils with large numbers of multi-ring aromatics and/or asphaltenes can pose a variety of challenges. Conventional hydroprocessing methods can be effective at improving API for a heavy oil feed, but the hydrogen consumption can be substantial. Conversion of the liquid to less valuable products, such as coke, can be another concern with conventional techniques. Desulfurizing techniques and systems which have been disclosed by others including those systems described in U.S. Pat. No. 8,894,845 to Vann et al., U.S. Pat. No. 8,696,890 to Soto et al. and U.S. Pat. No. 8,673,132 to Leta et al., react unoxidized sulfur at high temperatures to cause thermal cracking reactions in oil. Cracking reactions convert unoxidized sulfur compounds to $H_2S$, resulting in the production of olefins and increases in the aromaticity which may be undesirable.

There is thus a need for a system and method for desulfurization that is capable of at least one of removing oxidized sulfur containing compounds such as sulfones, operating at lower temperatures to avoid thermal cracking reactions, producing non-ionizable hydrocarbon products while having reactants that are easily regenerated in-situ.

SUMMARY OF THE TECHNOLOGY

A first embodiment of this disclosure relates generally to a caustic desulfonylation system comprising: a reactor vessel with a solid carbonaceous selectivity promoter provided therein; a liquid feed input of the reactor vessel configured to receive a source of caustic, a hydrocarbon feed comprising oxidized sulfur containing compounds and; a gas feed input of the reactor vessel configured to receive a source of hydrogen; and an output of the reactor vessel, wherein said output releases the caustic, and an upgraded hydrocarbon product with a sulfur content less than the sulfur content of the hydrocarbon feed received by the liquid feed of the reactor vessel.

A second embodiment of this disclosure relates generally to a method for performing a caustic desulfonylation reaction comprising the steps of: providing a reactor vessel, said reactor vessel; placing, within the reactor vessel, a solid selectivity promoter made of carbonaceous material; receiving, by the reactor vessel, a hydrocarbon feed comprising a oxidized sulfur compound, a caustic and hydrogen gas; contacting the solid selectivity promoter with the hydrocarbon feed and caustic in the presence of hydrogen gas; producing an upgraded hydrocarbon product with a sulfur content less than the sulfur content of the hydrocarbon feed; and regenerating the selectivity promoter with the hydrogen gas.

DETAILED DESCRIPTION OF THE DISCLOSURE

Figure 1A:
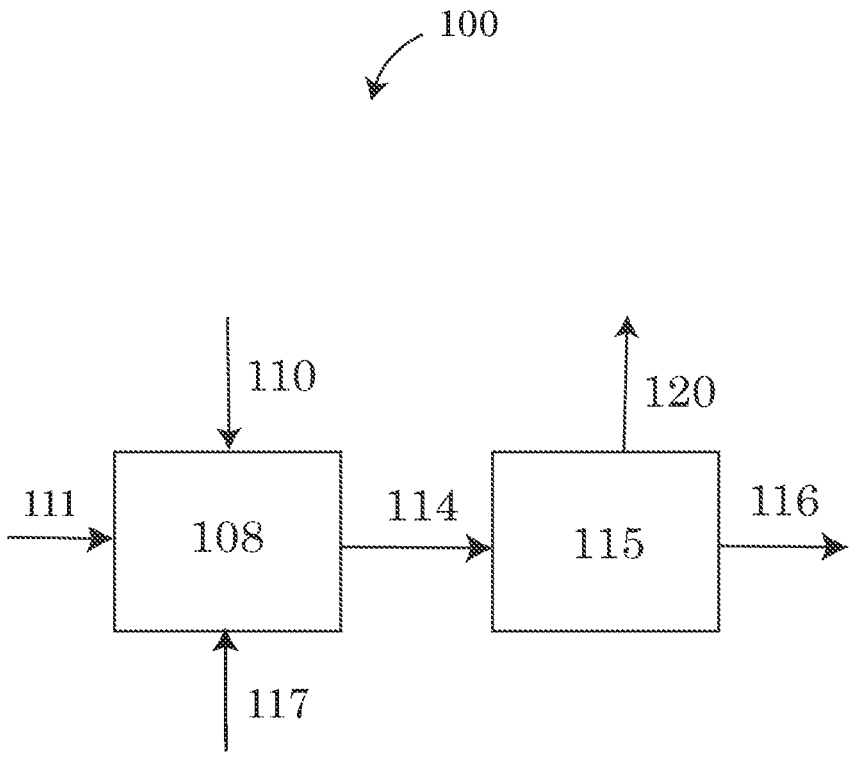
FIG. 1*a* depicts a flowchart describing an embodiment of a caustic desulfonylation treatment of a sulfone and/or sulfoxide rich hydrocarbon feed.

Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure. Reference will now be made in detail to certain embodiments of the disclosed methods and systems, examples of which are illustrated in part in the accompanying drawings and Examples below, which are provided for illustrative purposes intended for those skilled in the art and are not meant to be limiting in any way. For simplicity and clarity of illustration, reference numerals may be repeated among the figures to indicate corresponding or analogous elements.

As a preface to the detailed description, it should be noted that, as used in this specification and the appended claims, the singular forms "a", "an" and "the" include plural referents, unless the context clearly dictates otherwise.

Referring to the drawings, FIG. 1*a*, depicts a flow chart describing a system 100 and method for performing a caustic desulfonylation reaction consistent with the embodiments described herein. One or more alternative embodiments of the caustic desulfonylation system have been described and may be used as an alternative to the arrangement described in this application, so long as they are consistent with the disclosure here. For example, desulfonylation systems and equipment used to perform desulfonylation reactions described in U.S. Pat. Nos. 8,298,404 and 8,877,013 to Litz. et al., US Publication No. 2015/0337208 to Litz et al. and U.S. Pat. Nos. 8,197,671 and 8,894,843 to Rankin et al. are hereby incorporated by reference. Embodiments of the caustic desulfonylation systems and methods described herein may be performed within a reactor vessel 108. The reactor vessel 108 may be an oil/caustic reactor vessel, a promoted caustic visbreaker or a sulfone management unit in some embodiments. The reactor vessel 108 may be constructed out of any material suitable to withstand the basic conditions of the caustics being supplied to the reactor vessel 108. Examples of materials which may be suitable for constructing a reactor vessel may include iron, nickel, cobalt, and chromium based alloys and/or stainless steel alloys.

The reactor vessel 108 of the caustic desulfonylation system 100 may be configured to receive an oxidized hydrocarbon stream 111 comprising one or more oxidized sulfur containing species provided therein and/or one or more heteroatoms-containing hydrocarbons. Additional heteroatom containing compounds that may be present in the oxidized hydrocarbon stream may comprise oxidized sulfur components such as sulfoxide and sulfone rich hydrocarbons, as well as other compounds including, but not limited to those compounds comprising oxygen, nitrogen, nickel, vanadium, iron and other transition metals of the periodic table and combinations thereof. In some embodiments, the oxidized hydrocarbon stream 111 may be referred to as an oxidized heteroatom-containing hydrocarbon stream 111. The source of the oxidized hydrocarbon stream 111 may be connected to a liquid feed input (not shown) of the reactor vessel 108 allowing for the oxidized hydrocarbon stream to flow or be pumped into the reactor vessel 108 in either a metered or continuous fashion.

Inside the reactor vessel 108, the reactor vessel 108 may be provided with a solid selectivity promoter located therein. A solid selectivity promoter may refer to a substance in the solid state of matter that allows for a desulfonylation reaction to favor the production of reaction products that are non-ionizable hydrocarbon products and/or non-oxygenated hydrocarbon products. For example, the presence of a solid selectivity promoter in the reaction vessel 108 during a desulfonylation reaction may allow for the reaction to favor the production of biphenyl hydrocarbons as the dominant reaction product when dibenzothiophene sulfones are reacted. The solid selectivity promoter favors the non-ionized hydrocarbons over alternative reaction products formed by oxidized sulfur compounds such as ortho-phenyl phenolic compounds which may feature ionizable, oxygen containing hydrocarbon that may be the dominant reaction product when the solid selectivity promoter is not present. Embodiments of the solid selectivity promoter may be any solid substance that is chemically stable under the harsh basic conditions of the desulfonylation reaction and under temperatures up to about 350° C. In the exemplary embodiment, the solid selectivity promoter may be a carbonaceous material including but not limited to activated carbon, graphite, graphene, coal or asphaltenes or combinations thereof.

Embodiments of the solid selectivity promoter may be advantageous over selectivity promoters provided as a liquid or in solution because a solid selectivity promoter may remain inside the reactor vessel 108 both during and after the desulfonylation reaction has completed. Carbonaceous materials have excellent chemical resistance, and very high melting points. Carbonaceous materials are rarely used as catalysts for reactions, but a solid carbonaceous material may be more effective than comparative liquid selectivity promoters and have the ability to be regenerated in-situ by hydrogen which is unusual, unexpected and highly beneficial. The carbonaceous material disclosed herein effectively promotes the selectivity of the reaction to more valuable, non-ionizable hydrocarbons (e.g. dibenzothiophene sulfone to biphenyl).

Using a solid selectivity promoter and allowing it to remain inside the reactor vessel 108 may be advantageous over liquid or solutions comprising a selectivity promoter. Liquids and solutions comprising selectivity promoters may be eluted from the reactor vessel during the desulfonylation reaction, and may require further separation and recycling steps. Instead of being removed from the reactor vessel 108 and require further separation and recycling, a solid selectivity promoter may be regenerated inside the reactor vessel 108. In some embodiments, the solid selectivity promoter may further be advantageous because the solid selectivity promoter may be continuously regenerated in-situ during the desulfonylation reaction, ensuring that that the solid selectivity promoter may not be entirely used up during a continuous desulfonylation reaction.

Embodiments of the solid selectivity promoter may be regenerated by contacting the solid selectivity promoter with hydrogen gas 117. For example, in some embodiments of the desulfonylation system 100 described herein, the interior of the reactor vessel 108 containing the solid selectivity promoter may be pressurized with hydrogen gas 117. Embodiments of the reactor vessel 108 may include a gas feed input connected to a source of hydrogen gas 117. The hydrogen gas 117 may subsequently be metered or pumped into the reactor vessel 108 through the gas feed input until the reactor vessel has been pressurized. The pressure of the hydrogen provided within the reactor vessel 108 may range from atmospheric pressure up to about 1000 psig in some embodiments and more specifically between about 400-600 psig in alternative embodiments. In the exemplary embodiments the reactor vessel 108 may be provided with hydrogen gas to a pressure of about 200-500 psig.

Embodiments of the desulfonylation system may further comprise a caustic compound 110 being provided to the reactor vessel 108 in order to perform a desulfonylation reaction. The embodiments of the caustic compound 110 may be provided to the reactor vessel 108 by connecting a source of a caustic compound 110 to a liquid feed input of the reactor vessel 108. In some embodiments, the liquid feed receiving the caustic compound 110 may be a separate liquid feed from the liquid feed input receiving the oxidized hydrocarbon stream 111. In those instances where the caustic compound 110 and the oxidized hydrocarbon stream 111 each enter the reactor vessel 108 at a different liquid feed input, the liquid feed input may be referred to as a first liquid feed input, second liquid feed input, etc.

Embodiments of the caustic compound 110 being delivered to the liquid feed input of the reactor vessel 108 may be any inorganic compound that exhibits basic properties. Inorganic basic compounds may include, but are not limited to, inorganic oxides from group IA and IIA elements of the periodic table, inorganic hydroxides from group IA and IIA elements, or optionally mixtures of oxides and hydroxides of group IA and IIA elements, molten hydroxides of group IA and IIA elements, or optionally mixtures of hydroxides of said elements. Specific examples of the caustic compound (optionally at about 50% weight in water) may include $Li_2O$, $Na_2O$, $K_2O$, $Rb_2O$, $Cs_2O$, $Fr_2O$, $B_2O$, MgO, CaO, SrO, BaO, and the like as well as LiOH, NaOH, KOH, RbOH, CsOH, FrOH, $Be(OH)_2$, $Mg(OH)_2$, $Ca(OH)_2$, $Sr(OH)_2$, $Ba(OH)_2$, green liquor, mixtures or molten mixtures thereof.

As shown in FIG. 1*a*, a desulfonylation reaction may occur when the reactants comprising the oxidized hydrocarbon stream 111 and the caustic 110 each enter the reactor vessel 108 where they mix under the pressure of the hydrogen gas 117 and make contact with the solid selectivity promoter present in the reactor vessel 108. The temperature of the reaction vessel 108 may be maintained during the desulfonylation reaction at approximately about 200-500° C. and in the exemplary embodiments between about 275-300° C. As a result of the desulfonylation reaction, a mixture of one or more reaction products may exit the reactor vessel 108 via route 114 of the desulfonylation system 100, from an output of the reaction vessel 108. The mixture of one or more reaction products exiting the reactor vessel 108 may include an upgraded hydrocarbon product 120 which may be non-ionized hydrocarbon product, as well as the caustic, water, unconsumed hydrogen gas and sulfur containing compounds, Not intending to be bound by any particular theory, the following net equation generally describes an example of the reagents used and products observed:

$$2NaOH+R(SO2)R'+H_2 \rightarrow H_2O+Na_2SO_3+R—H+R'—H.$$

In some embodiments, R and R' may even be further linked as part of a heterocyclic structure, for instance in the example of this reaction provided below:

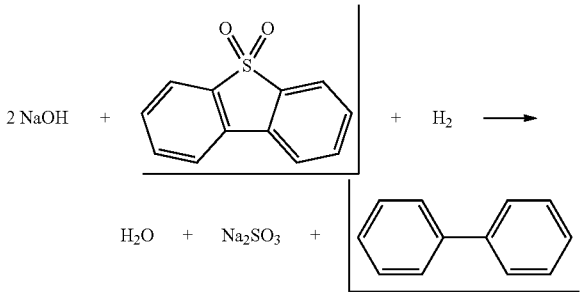

In some embodiments, the mixture of reaction products exiting the output of the reaction vessel via route 114 may further be sent to a separating vessel 115. The separating vessel 115 may be a gravity settler in some embodiments. Inside the separating vessel 115, upgraded hydrocarbon product 120 may separate into a light phase while the water, sulfur containing compounds, residual caustic and reaction by-products may separate into a heavier dense phase 116. Subsequently, the light phase comprising the upgraded hydrocarbon products 120 can be removed and isolated from the dense phase 116. In alternative embodiments, the reaction vessel 108 may also serve as the separating vessel 115.

In some embodiments, upgraded hydrocarbon products 120 obtained and separated from the separator vessel 115 may be further washed, refined or utilized for gas, oil, fuel, lubricants or other hydrocarbon based products and further treated using known refinery processes. In some embodiments, the upgraded hydrocarbon product 120 may further be washed to remove traces of reaction by-products that may not have fully separated into the dense phase. The removal of the traces of the reaction by-products such as sulfur containing compounds, and excess caustic may be removed using methods including, but not limited to, solvent extraction, washing with water, centrifugation, distillation, vortex separation, and membrane separation and/or combinations thereof. Trace quantities of caustic may also be removed using electrostatic desalting and dewatering techniques according to known methods by those skilled in the art.

Figure 1B:
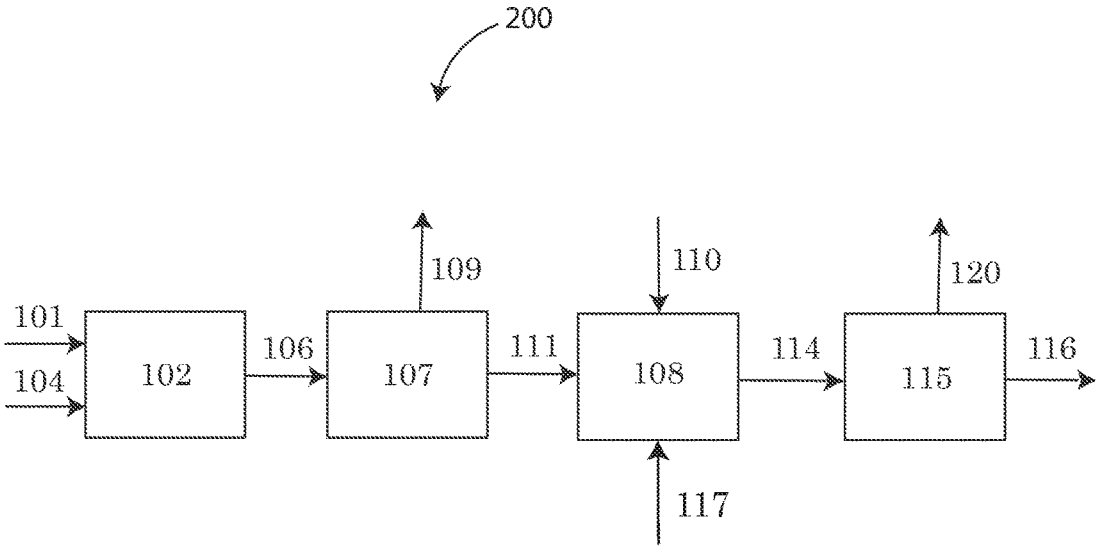
FIG. 1*b* depicts a flow chart of an embodiment of oxidative desulfurization of a hydrocarbon feed using embodiments of caustic desulfonylation.

Referring to FIG. 1*b*, in some embodiments the desulfonylation system 100 shown in FIG. 1*a* may be further incorporated into an oxidative desulfurization system 200 performing one or more oxidation steps to a hydrocarbon stream 101 prior to becoming the oxidized hydrocarbon stream 111 entering the reactor vessel 108. The hydrocarbon stream 101 may be combined with an oxidant 104 and subjected to an oxidation reaction inside an oxidizer vessel 102. Embodiments of the oxidation step may be carried out using at least one oxidant, optionally in the presence of a catalyst. Suitable oxidants 104 may include organic peroxides, hydroperoxides, hydrogen peroxide, $O_2$, air, $O_3$, peracetic acid, organic hydroperoxides may include benzyl hydroperoxide, ethylbenzene hydroperoxide, tert-butyl hydroperoxide, cumyl hydroperoxide and mixtures thereof, other suitable oxidants may include sodium hypochlorite, permanganate, biphasic hydrogen peroxide with formic acid, nitrogen containing oxides (e.g. nitrous oxide), and mixtures thereof, with or without additional inert organic solvents.

In an alternative embodiment, the step of oxidation may further include an acid treatment (not shown) including at least one immiscible acid. The immiscible acid and oxidant treatment may remove a portion of the heteroatom contaminants from the feed, wherein upon being oxidized by the immiscible acid and oxidant, the heteroatoms may become soluble in the acid phase, and be subsequently removed via a heteroatom containing by-product stream. The immiscible acid used may be any acid which is insoluble in the hydrocarbon oil phase. Suitable immiscible acids may include, but are not limited to, carboxylic acids, sulfuric acid, hydrochloric acid, and mixtures thereof, with or without varying amounts of water as a diluent. Suitable carboxylic acids may include, but are not limited to, formic acid, acetic acid, propionic acid, butyric acid, lactic acid, benzoic acid, and the like, and mixtures thereof, with or without varying amounts of water as a diluent.

In some embodiments, the oxidation reaction(s) may be carried out at a temperature of about 20° C. to about 120° C., at a pressure of about 0.1 atmospheres to about 10 atmospheres, with a contact time of about 2 minutes to about 180 minutes.

A catalyst may be used in the presence of the oxidant 104. A suitable catalyst may include transition metals including but not limited to Ti(IV), V(V), Mo(VI), W(VI), transition metal oxides, including ZnO, $Al_2O_3$, CuO, layered double hydroxides such as $ZnAl_2O_4.x(ZnO)y(Al_2O_3)$, organometallic complexes such as $Cu_xZn_{1-x}Al_2O_4$, zeolite, $Na_2WO_4$, transition metal aluminates, metal alkoxides, such as those represented by the formula $M_mO_m(OR)_n$, and polymeric formulations thereof, where M is a transition metal such as, for example, titanium, rhenium, tungsten, copper, iron, zinc or other transition metals, R may be a carbon group having at least 3 carbon atoms, where at each occurrence R may individually be a substituted alkyl group containing at least one OH group, a substituted cycloalkyl group containing at least one OH group, a substituted cycloalkylalkyl group containing at least one OH group, a substituted heterocyclyl group containing at least one OH group, or a heterocyclylalkyl containing at least one OH group. The subscripts m and n may each independently be integers between about 1 and about 8. In some embodiments, R may be substituted with halogens such as F, Cl, Br, and I. For example, embodiments of the metal alkoxide catalyst may include bis(glycerol)oxotitanium(IV)), wherein M is Ti, m is 1, n is 2, and R is a glycerol group. Other examples of metal alkoxides include bis(ethyleneglycol)oxotitanium (IV), bis (erythritol)oxotitanium (IV), bis(sorbitol)oxotitanium (IV).

The sulfoxidation catalyst may further be bound to a support surface. The support surface may include an organic polymer or an inorganic oxide. Suitable inorganic oxides include, but are not limited to, oxides of elements of groups IB, II-A, II-B, III-A, III-B, IV-A, IV-B, V-A, V-B, VI-B, of the Periodic Table of the Elements. Examples of oxides that may be used as a support include copper oxides, silicon dioxide, aluminum oxide, and/or mixed oxides of copper, silicon and aluminum. Other suitable inorganic oxides which may be used alone or in combination with the abovementioned oxide supports may be, for example, MgO, $ZrO_2$, $TiO_2$, CaO and/or mixtures thereof. Other supports may include talc.

The support materials used may have a specific surface area in the range from 10 to 1000 $m^2/g$, a pore volume in the range from 0.1 to 5 ml/g and a mean particle size of from 0.1 to 10 cm. Preference may be given to supports having a specific surface area in the range from 0.5 to 500 $m^2/g$, a pore volume in the range from 0.5 to 3.5 ml/g and a mean particle size in the range from 0.5 to 3 cm. Particular preference may be given to supports having a specific surface area in the range from 200 to 400 $m^2/g$, and a pore volume in the range from 0.8 to 3.0 ml/g.

After subjecting the hydrocarbon stream 101 to oxidation conditions in the oxidizer vessel 102, an intermediate stream 106 may be generated. A hydrocarbon feed 101 containing, for example sulfur-based heteroatom contaminants such as thiophenes, benzothiophenes, dibenzothiophenes and thioethers and others may be converted to a sulfone or sulfoxide rich intermediate stream 106. The intermediate hydrocarbon stream 106 may include oxidized heteroatom containing compounds and oxidant by-products. In some embodiments, the intermediate stream 106 may be subjected to distillation 107, for example in a distillation column. During distillation 107, the oxidized heteroatom containing compounds, may be separated from the oxidant by-products 109. The oxidant by-products may be recovered and recycled. As a result of the distillation 107, an oxidized hydrocarbon stream 111 may be formed including oxidized sulfur compounds such as sulfones and sulfoxide rich hydrocarbons. The sulfone and sulfoxide rich hydrocarbon stream 111 may be sent to the reactor vessel 108 to perform the desulfonylation reaction as described above.

Embodiments of methods for performing a caustic desulfonylation reaction, consistent with the desulfonylation system described above may be performed in accordance with the steps described herein. For instance, in some embodiments, the method for performing the caustic desulfonylation reaction may include the step of providing the reactor vessel 108 and placing within the reactor vessel a solid selectivity promoter, such as a solid selectivity promoter made of a carbonaceous material. Embodiments of the method steps may further include the step of receiving, by the reactor vessel 108, a caustic and/or hydrogen gas and an oxidized hydrocarbon feed 111 comprising one or more heteroatom containing compounds which may include oxidized sulfur compounds.

As the reactor vessel 108 is continuously or in a metered fashion, receiving the oxidized hydrocarbon feed 111, caustic 110 and hydrogen gas 117, the oxidized hydrocarbon feed 111, caustic 110 and hydrogen gas 117 may be contacting the solid selectivity promoter. As result of the oxidized hydrocarbon feed 111 and caustic 110 contacting one another in the presence of the solid selectivity promoter, the resulting desulfonylation reaction may be producing an upgraded hydrocarbon product 120 having a reduced heteroatom content. More specifically, the upgraded hydrocarbon product 120 produced may have a sulfur content that is less that the sulfur content of the oxidized hydrocarbon feed 111. Moreover, the resulting upgraded hydrocarbon product 120 produced may be non-ionized hydrocarbon products as described above.

Furthermore, in some embodiments, as the desulfonylation system is performing the desulfonylation reaction inside the reactor vessel 108, simultaneously, or near simultaneously, the hydrogen gas 117 entering the reactor vessel 108 may be continuously regenerating the solid selectivity promoter being utilized as a desulfonylation reactant. In some embodiments, the regenerating step may also be performed by exposing the solid selectivity promoter inside the reactor vessel 108 to the hydrogen gas 117 after the desulfonylation reaction is performed.

The following working examples are provided for illustrative purposes. The working examples are intended to be non-limiting and are intended to further explain and assist in clarifying one or more of the elements of the embodiments described above in the current disclosure:

Example 1. Desulfurization of Sulfoxidized Bitumen

A 1000 mL reactor made of nickel was filled with 43.6 grams of activated carbon (3.6 moles), 45.7 grams of 50% sodium hydroxide in water, 125.7 grams of a bitumen oil containing 4.54% by weight of sulfur which had been previously subjected to sulfoxidation to convert sulfur species to sulfones (0.09 moles sulfones), and 26.6 grams of toluene as a solvent. The reactor was purged with nitrogen gas and then pressurized with 150 psig hydrogen gas (0.32 moles). The reactor was heated to 300° C. and stirred at 600 RPM for 90 minutes. The reactor was then cooled and the oil contents centrifuged to remove any caustic, activated carbon, or reaction by-products. The centrifuged oil was analyzed for sulfur content and density. The sulfur content of the bitumen was reduced by 47% from 4.54% wt sulfur to 2.41% wt sulfur. The density of the bitumen before sulfoxidation was 1.009 g/mL at 15° C., which dropped to 0.9746 g/mL at 15° C. after treatment.

Example 2. Desulfurization of Dibenzothiophene Sulfone

A 300 mL reactor made of nickel was filled with 17.1 grams of activated carbon (1.4250 moles), 17.1 grams of 50% sodium hydroxide in water, 7.7 grams of dibenzothiophene sulfone (0.0356 moles), and 50.2 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. All of the initial dibenzothiophene sulfone had been converted, with 33.7 mole percent converted to biphenyl and 7.95 mole percent converted to ortho-phenylphenol.

Comparative Example 1. Desulfurization of Dibenzothiophene

An experiment was performed as in example 2, except that an un-sulfoxidized sulfur compound (dibenzothiophene) was used in place of a sulfone compound. A 300 mL reactor made of nickel was filled with 16.9 grams of activated carbon (1.4083 moles), 17.0 grams of 50% sodium hydroxide in water, 6.4 grams of dibenzothiophene (0.0348 moles), and 51.5 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. Only dibenzothiophene was recovered. The HPLC did not detect any reaction products.

Comparative Example 2. Desulfurization of Dibenzothiophene Sulfone without Carbon Present An experiment was performed as in example 2, but without activated carbon present. A 300 mL reactor made of nickel was filled with 20.1 grams of 50% sodium hydroxide in water, 9.0 grams of dibenzothiophene sulfone (0.0147 moles), and 53.5 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. 13.87 mole percent of the initial dibenzothiophene sulfone had been converted, with 4.06 mole percent converted to ortho-phenylphenol and 0 mole percent converted to biphenyl.

Comparative Example 3. Desulfurization of Un-Sulfoxidized Bitumen

An experiment was performed as in example 1, but the bitumen was not subjected to sulfoxidation, so the sulfur in the oil had not been converted to sulfones. A 300 mL reactor made of nickel was filled with 15.0 grams of activated carbon (1.25 moles), 15.5 grams of 50% sodium hydroxide in water, 48.6 grams of a bitumen oil containing 4.54% by weight of sulfur (0.0690 moles sulfur), and 11.8 grams of toluene as a solvent. The reactor was purged with nitrogen gas and then pressurized with 200 psig hydrogen gas (0.14 moles). The reactor was heated to 300° C. and stirred at 600 RPM for 90 minutes. The reactor was then cooled and the oil contents centrifuged to remove any caustic, activated carbon, or reaction by-products. The centrifuged oil was analyzed for sulfur content and density. The sulfur content of the bitumen was only decreased by 5% from 4.54% wt sulfur to 4.32% wt sulfur.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A method for performing a caustic desulfonylation reaction comprising the steps of:

providing a reactor vessel;

placing, within the reactor vessel, a solid selectivity promoter made of carbonaceous material;

receiving, by the reactor vessel, a hydrocarbon feed comprising an oxidized sulfur compound, a caustic, and hydrogen gas;

contacting the solid selectivity promoter with the hydrocarbon feed and the caustic in the presence of the hydrogen gas;

producing an upgraded hydrocarbon product with a sulfur content less than the sulfur content of the hydrocarbon feed; and regenerating the solid selectivity promoter with the hydrogen gas.

2. The method of claim 1, wherein the carbonaceous material comprises at least one of activated carbon, graphite, graphene, coal, and an asphaltene.

3. The method of claim 1, wherein an interior of the reactor vessel is pressurized with the hydrogen gas.

4. The method of claim 3, wherein the interior of the reactor vessel is pressurized with the hydrogen gas to a pressure of at least 200 psig.

5. The method of claim 1, wherein the caustic comprises an inorganic basic compound.

6. The method of claim 5, wherein the inorganic basic compound includes at least one of: an inorganic oxide from a group IA or IIA element, an inorganic hydroxide from a group IA or IIA element, a mixture of oxides and hydroxides from group IA or IIA elements, a molten hydroxide from a group IA or IIA element, and a mixture of hydroxides from group IA or IIA elements.

7. The method of claim 5, wherein the caustic comprises the inorganic basic compound at about 50% weight in water.

8. The method of claim 5, wherein the caustic comprises at least one of: $Li_2O$, $Na_2O$, $K_2O$, $Rb_2O$, $Cs_2O$, $Fr_2O$, $B_2O$, MgO, CaO, SrO, BaO, LiOH, NaOH, KOH, RbOH, CsOH, FrOH, $Be(OH)_2$, $Mg(OH)_2$, $Ca(OH)_2$, $Sr(OH)_2$, $Ba(OH)_2$, and green liquor.

9. The method of claim 1, wherein the hydrocarbon feed comprising the oxidized sulfur compound is formed by reacting a hydrocarbon stream with an oxidant.

10. The method of claim 9, wherein an intermediate stream is generated by reacting the hydrocarbon stream with the oxidant and the intermediate stream is subjected to distillation to form the hydrocarbon feed comprising the oxidized sulfur compound.

11. The method of claim 9, wherein the oxidized sulfur compound of the hydrocarbon feed is also formed by an acid treatment.

12. The method of claim 9, wherein a catalyst is used in the presence of the oxidant.

13. The method of claim 12, wherein the catalyst is bound to a support surface.

14. The method of claim 13, wherein the support surface comprises one of an organic polymer and an inorganic oxide.

15. A caustic desulfonylation reaction method comprising:

providing a solid selectivity promoter made of carbonaceous material;

contacting the solid selectivity promoter with a hydrocarbon feed and a caustic;

producing an upgraded hydrocarbon product with a sulfur content less than the sulfur content of the hydrocarbon feed; and regenerating the selectivity promoter with hydrogen gas.

16. The method of claim 15, wherein the regenerating step occurs continuously while the caustic desulfonylation reaction method occurs.

* * * * *